United States Patent [19]
Burt

[11] Patent Number: 4,484,562
[45] Date of Patent: Nov. 27, 1984

[54] FLEXIBLE DISK DAMPER

[75] Inventor: Daryl D. Burt, Golden, Colo.

[73] Assignee: Adolph Coors Company, Golden, Colo.

[21] Appl. No.: 492,373

[22] Filed: May 6, 1983

[51] Int. Cl.³ ..... F23L 13/00
[52] U.S. Cl. ..... 126/285 R; 126/292; 126/295; 126/296; 251/58; 251/358; 98/101; 236/93 R; 236/101 R; 110/147; 110/163
[58] Field of Search ..... 126/285, 292, 295, 296; 236/93 R, 101; 98/101; 110/147, 163; 251/334, 358, 86

[56] References Cited

U.S. PATENT DOCUMENTS

| | | | |
|---|---|---|---|
| 123,298 | 1/1872 | Shontz | 126/295 |
| 274,117 | 3/1883 | Getty et al. | 126/296 |
| 367,847 | 8/1887 | Ridgway | 236/101 R |
| 713,055 | 11/1902 | Burton | 126/296 |
| 1,012,266 | 12/1911 | Miller | 126/295 |
| 1,449,876 | 3/1923 | Williams | 251/334 |
| 2,684,647 | 7/1954 | Bither | 126/296 |
| 3,521,659 | 6/1970 | Seger | 251/334 |
| 3,905,577 | 9/1975 | Karpenko | 251/334 |

FOREIGN PATENT DOCUMENTS

| | | | |
|---|---|---|---|
| 0161361 | 4/1921 | United Kingdom | 126/285 |
| 0679038 | 9/1952 | United Kingdom | 126/285 |

*Primary Examiner*—Samuel Scott
*Assistant Examiner*—Helen Ann Odar
*Attorney, Agent, or Firm*—Klaas & Law

[57] ABSTRACT

A flexible disk damper which is capable of providing tight seals for a large diameter opening over a wide range of temperatures. Disks are made sufficiently flexible to compensate for inherent warpage in the damper seat by using a steel with a higher yield strength. Additionally, a varying cross-sectional thickness of the flexible disk is provided to ensure that unit stress is not exceeded along any point of the radius of the flexible disk for the deformation required to provide a tight seal. A pneumatic cylinder is utilized to provide a constant pressure to the flexible disks. A damper seat is fabricated from a cut plate or flat bar which is formed in an annulus. A deflection cone is utilized to deflect flue gases. The flexible disk is coupled together by bolts which are disposed in holes sufficiently large to allow independent movement of the disks to maximize deflection.

7 Claims, 6 Drawing Figures

FLEXIBLE DISK DAMPER

BACKGROUND OF THE INVENTION

The present invention pertains generally to flue gas dampers and more particularly to disk dampers.

With the advent of the increased use of pulverized coal in power plants as a result of increased price in petroleum based fuels, there has been an increased need for devices to protect the environment, such as flue gas scrubbers, bag houses, precipitory sprayers and associated bypasses which require extensive use of large reliable dampers. The increased use of large dampers has also been necessitated by an increase in power plant size, a general increase in complexity, the need to isolate portions of ducting for the purpose of inspection and repair, and the economic aspects of providing heat recovery systems to increase efficiency of the overall system. Larger dampers are preferable to smaller dampers since larger dampers produce less pressure drop across the damper surface and allow use of components which are more economical from a capital investment and operational standpoint. For example, large bypass dampers used in conjunction with bag houses in a pulverized coal plant can greatly reduce the specifications of a stack exhaust fan, and consequently greatly improve the economies of a power plant from a capital investment and operational standpoint. Additionally, the ability of a damper to provide a tight seal can greatly reduce heat loss in certain applications and consequently further improve the economics of the power plant system.

However, various problems exist in producing large dampers which provide a large opening, are reliable in operation, require low maintenance, have a long lifetime, are fast acting, erosion resistant and capable of providing a tight seal over a wide range of temperatures. Various dampers have been designed to meet these requirements and provide both control and isolation, including the louver damper, guillotine damper, butterfly damper, swinging blade damper, and the disk or poppet damper.

The louver type damper consists of several louver blades mounted in a parallel manner across a duct with a centrally pivoted shaft extending through a frame and driven by a linkage. Louver dampers are versatile in that they fit in most ducting at any attitude, are compact and require little external clearance, are lightweight, provide a drive which is readily accessible, have a simple control function, provide a quick response to thermal transients, are fast opening and closing, provide low leakage to the outside environment, and require low actuation power. However, the disadvantages of the louvered damper are its large leakage perimeter, high leakage rates through the seals in a closed position, high pressure drop due to blade and seal obstruction of the flow, and inherent problems which exist because the blades and seals are always disposed in the gas flow. For example, the blades tend to corrode, catch ash and waste material from the scrubber, and produce a fluttering motion resulting from the flimsiness of the long thin blades in the gas flow causing buckling and warping of the blades and, leakage and jamming of the louvered damper.

Guillotine type dampers are capable of providing isolation to permit inspection, maintenance and repair of items, providing a low pressure drop across the damper, and resistance to damage from surges in furnace pressure. However, guillotine dampers are slow moving, require large drive mechanisms due to the heavy weight of the blade, require a large structure outside the duct to support the drive mechanism and retracted blade, are susceptible to wear and corrosion in the drive mechanism, are sensitive to attitude, are difficult to unjam and are unable to modulate gas flow.

Butterfly or wafer dampers are light weight, simple, quickly actuated, and often comparatively low in cost. The disadvantages in the butterfly damper include high leakage, blade flutter, tendency of the blade to warp, and the necessity for a large clearance for the open blade. The frame of butterfly dampers is normally light, so twisting and distortion can easily occur.

Swinging blade dampers, are simple and can withstand high temperatures and the blade is located out of the gas flow so erosive particles do not impact directly on the surface of the swinging blade directly. The disadvantages of the swinging blade damper include the requirement of a large frame and drive mechanism, and flutter of the blade when moving across the flow or splitting a flow between outlets. The swinging blade damper can be attitude sensitive and requires special seals along side portions.

The conventional disk or poppet type damper is fast actuating and can provide and initial slow opening stroke which is particularly useful in baghouse operations to prevent damage to the bags. This type of damper uses a metal to metal contact to form a seal between a seat and flexible disk edge. For large diameter disk dampers, flexible disks are incapable of providing a tight seal due to inability of large disks to deform sufficiently to accommodate large displacements resulting from inherent warpage of the disk and seat. This type of damper is employed over a wide range of temperatures, i.e., room temperature to approximately 450° in pulverized coal plants, and up to 950° in gas turbine plants. This wide range of temperatures results in inherent warpage of the damper seat, which is especially prevalent in large opening disk type dampers, such as those having a diameter greater than 4 feet. The use of flexible materials such as silicons has been ineffective since these materials tend to brittlize and are incapable of maintaining a tight seal across high pressure differentials. For diameters greater than 4 feet, additional problems exist since normal sheet metal is fabricated in widths of 4 feet. Additional warpage is encountered during fabrication due to the necessity to weld sheets together to accommodate openings larger than 4 feet.

If a flexible disk is attempted to be deformed sufficiently to accommodate large displacements resulting from inherent warpage of the seat, the yield point of the metal of the flexible disk can be exceeded to cause permanent deformation. In other words, normally the yield strength of the flexible disk is insufficient to prevent permanent deformation to accommodate the displacements of the seat due to inherent warpage. The yield point is defined as the minimum unit stress at which a structural material will deform without an increase in the load, while the yield strength is defined as the unit stress corresponding to a specific amount of permanent unit deformation. Regular carbon steels have been incapable of providing sufficient deformation to provide a seal for large diameter flexible disk dampers, i.e. greater than 4 feet, without causing permanent deformation of the disk because of inherent warpage in the seat due to the wide range of temperatures at which disk dampers are employed. In other words, flexible disks using conventional carbon steels are incapable of compensating for normal warpage in the disk damper seat for large disk diameters.

In an attempt to overcome the problems of inherent warpage in the damper seat, grinding of the damper seat has been employed in prior art devices in an attempt to reduce the necessity of large displacements of flexible disk. Additionally, anti-rotation guides have been placed on the disk spindle to make certain that the disk will repeat its positioning location on the disk seat for each closing. In this manner, the circumferential orientation of the flexible disk in the annular seat remains fixed.

However, warpage of the damper seat can have a large variation as a result of the wide range of temperatures in which the damper is used. Consequently, it is difficult to determine which areas should be ground to provide a seal at full operating temperature. Moreover, seats which could be ground to provide a seal at full operating temperature may not provide a sufficient seal at lower temperatures, and consequently severely stress the utility of the damper. Moreover, the process of grinding of the damper seat is expensive and time consuming, and results in a damper which, in many cases, is marginally effective.

OBJECTS OF THE INVENTION

It is therefore and object of the present invention is to provide an improved damper.

It is also an object of the present invention to provide an improved flexible disk damper.

Another object of the present invention is to provide a flexible disk damper which is capable of forming a tight seal.

Another object of the present invention is to provide a large diameter flexible disk damper.

Another object of the present invention is to provide a large diameter flexible disk damper which is capable of providing a tight seal for a large diameter opening over a wide range of temperature.

Another object of the present invention is to provide a large diameter flexible disk damper which is capable of providing a tight seal for an opening of at least 4 feet in diameter over a wide range of temperatures.

Additional objects, advantages and novel features of the invention are set forth in part in the description of the invention which follows and will be understood by those skilled in the art upon examination of the following or may be learned by practice of the invention. Objects and advantages of the invention may be realized or obtained by means of the instrumentalities and combinations particularly pointed out in the appended claims.

SUMMARY OF THE INVENTION

To achieve the foregoing and other objects and in accordance with the purposes of the present invention as embodied and described herein, the apparatus of the present invention may comprise a flexible disk damper comprising: a damper seat; flexible disk means formed from a metal which is capable of providing sufficient deformation to form a seal between the damper seat and the flexible disk means for all circumferential orientations of the flexible disk means while simultaneously providing a variable cross-sectional thickness such that the metal has a yield strength which is sufficient to prevent permanent deformation.

The present invention may also comprise a flexible disk damper comprising: a damper seat; flexible disk means formed from a metal which is capable of providing sufficient deformation in response to a predetermined force to form a seal between the damper seat and the flexible disk means for all circumferential orientations of the flexible disk means while simultaneously providing a cross-sectional thickness which increases with radial distance towards the center of the flexible disk means such that the predetermined force produces a predetermined unit stress which is less than the yield point of the metal having the cross-sectional thickness for all points on the flexible disk means.

The present invention may also comprise a large diameter flexible disk damper which is capable of providing a tight seal for a large diameter opening over a wide range of temperatures comprising annulus means having a sealing surface for forming a damper seat with an inherent warpage; flexible disk means formed from a material which is capable of providing sufficient flexibility to deform the flexible disk means in the annulus means by an amount sufficient to compensate for the inherent warpage of the annulus means and form a tight seal with the annulus means for any circumferential orientation of the flexible disk means with the annulus means, the material having a yield strength which is sufficient to prevent permanent deformation of the flexible disk means while simultaneously providing sufficient flexibility to form a seal for large displacements of the flexible disk means due to the inherent warpage.

The present invention may also comprise a flexible disk damper which is capable of providing a tight seal for an opening of at least 4 feet in diameter over a wide range of temperatures comprising an annulus disposed to form a damper seat having an inherent warpage resulting from the diameter of the opening and operation of the damper over a wide range of temperatures, a plurality of flexible disks formed from a metal which is capable of providing sufficient flexibility to deform the flexible disk means by an amount sufficient to compensate for the inherent warpage and form a tight seal with the annulus for any circumferential orientation of the plurality of flexible disks with the annulus, the flexible disks arranged by size to provide a predetermined cross-sectional thickness which increases with radial distance towards the center of the plurality of flexible disks such that the force required to deform the plurality of flexible disks produces a unit stress which is less than the yield point of the metal having the predetermined cross-sectional thickness; means for coupling the plurality of flexible disks to allow the plurality of flexible disks to independently flex during deformation.

The advantages of the present invention are that the flexible disk damper is capable of providing sufficient deformation to form a seal between a damper seat and a flexible disk for all circumferential orientations of flexible disk with the seat while simultaneously providing a yield strength which is sufficient to prevent permanent deformation. The invention utilizes a plurality of flexible disks of various diameters which are arranged to provide a variable cross sectional thickness so that forces produced during deformation to compensate for inherent warpage of the seat do not exceed the yield point of the metal utilized in the flexible disk. The present invention is therefore capable of providing a tight seal for large diameter openings, i.e. greater than 4 feet in diameter, and simultaneously, compensating for inherent warpage of the seat without grinding the seat to reduce inherent warpage. The present invention can be implemented over a wide range of temperatures, providing a tight seal in a device which is reliable, requires low maintenance, has a long lifetime, is corrosion resistant, and can be rapidly actuated.

BRIEF DESCRIPTION OF THE DRAWINGS

An illustrative and presently preferred embodiment of the invention is shown in the accompanying drawings wherein.

DETAILED DESCRIPTION OF THE INVENTION

Figure 1:
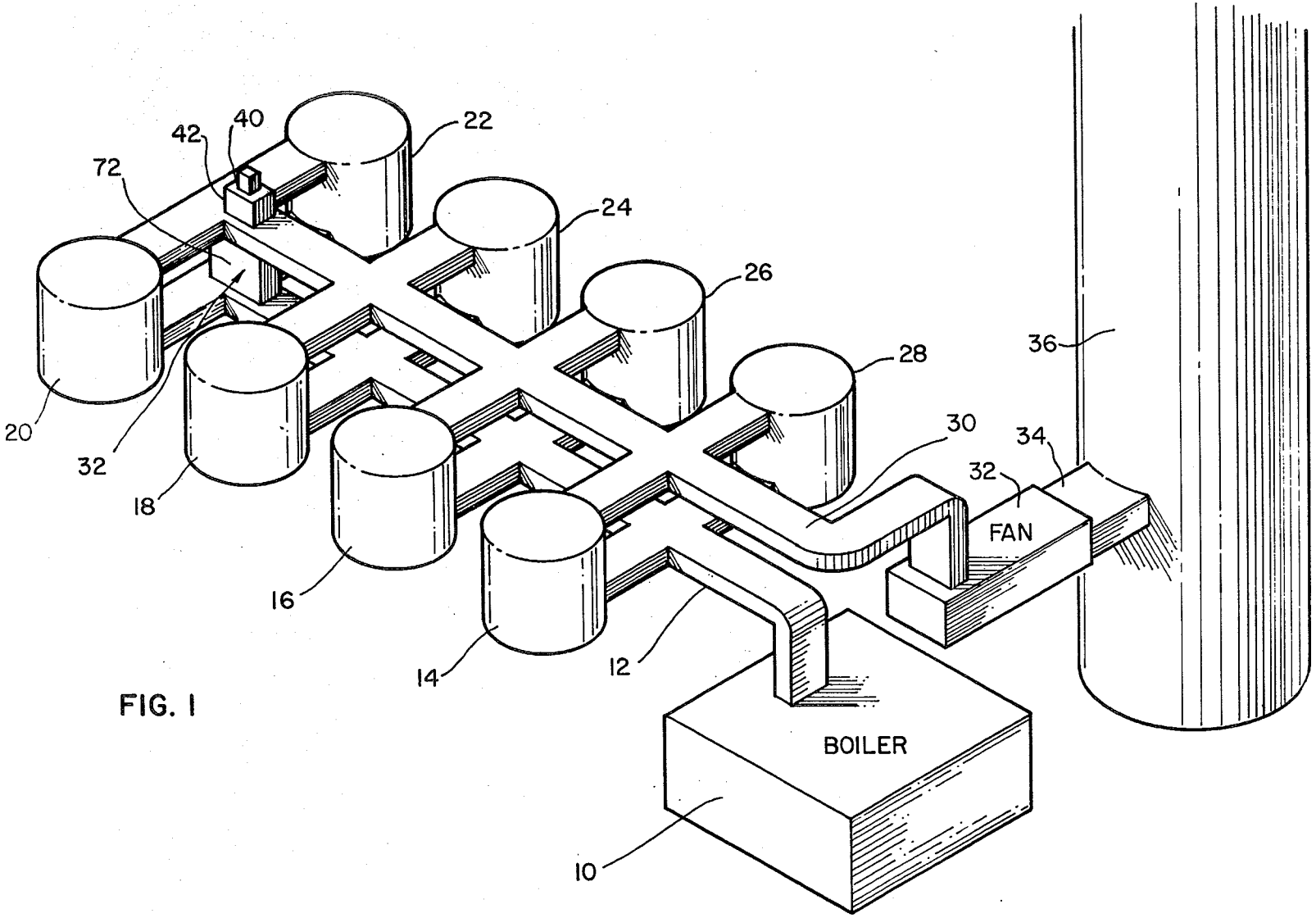
FIG. 1 is a schematic perspective view illustrating the manner in which the device of the present invention is implemented as a by-pass for baghouse service.

FIG. 1 schematically illustrates the manner in which the device of the present invention is implemented in a baghouse system. As shown in FIG. 1, a boiler 10 produces exhaust gases which are vented through duct 12 to a series of baghouse cylinders 14–28. A plurality of bags are disposed in baghouse cylinders 14–28 to remove particulates from the exhaust fumes emitted by boiler 10. After the particulates are removed from the exhaust gases, the exhaust gases are vented through duct 30 by way of a fan 32, which imparts a negative pressure in duct 30. Duct 34 then vents the exhaust gases to stack 36 for venting to the atmosphere.

Occasionally, it is necessary to by-pass the baghouse cylinders for various reasons such as when exhaust gases from boiler 10 are too hot to vent through the bags and could possibly cause a fire. It is desirable to provide a large damper opening which functions as a by-pass to minimize pressure drop in the by-pass by reduce requirements in fan 32 and ensure that exhaust gases by-pass the baghouse cylinders. As shown in FIG. 1, by-pass damper 32 of the present invention is disposed between ducts 12 and 30 to bypass baghouse cylinders 14–28.

Figure 2:
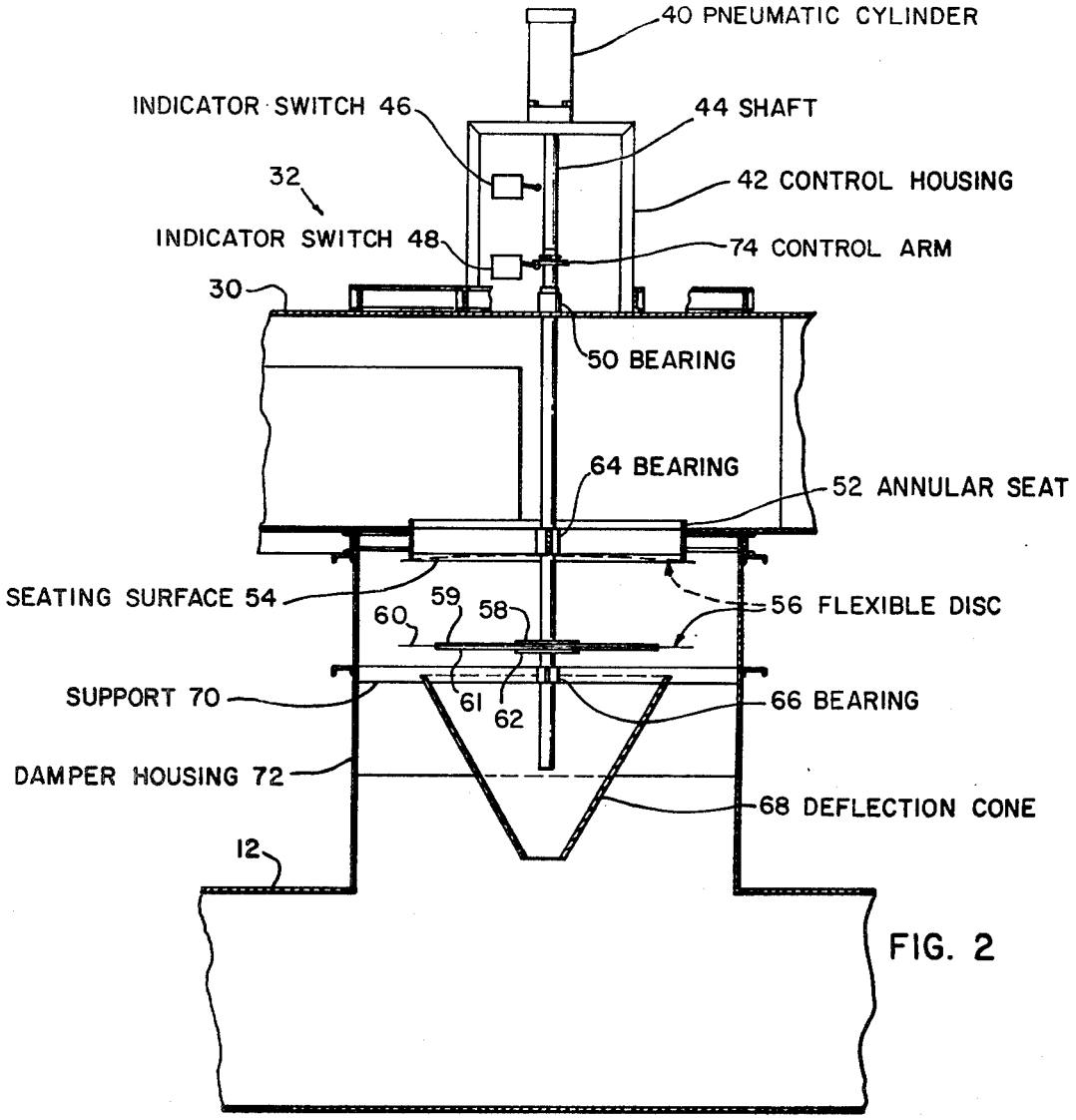
FIG. 2 is a cross-sectional diagram of the device of the present invention.

FIG. 2 is a schematic cross-sectional diagram of the flexible disk damper 32 of the present invention. The flexible disk damper has a pneumatic cylinder 40 shown in both FIGS. 1 and 2, which is disposed above control housing 42 on vent 30. Damper housing 72 is disposed between vent 30 and vent 12. Shaft 44 is coupled to pneumatic cylinder 40 inside of control housing 42. Shaft 44 is held in place by bearings 50,64, 66 which allow vertical movement of shaft 44. Bearing 66 is mounted on support 70 while bearing 50 is mounted on the upper portion of vent 30. Indicator switches 46, 48 have control arms which are activated by control arm 74. Bearing 64 is supported in the center of annular seat 52 to center shaft 44 within the annular seat. Flexible disk 56 comprises a plurality of flexible disks 58, 60, 62 that are mounted on shaft 44. Flexible disk 62 has a generally circular shape which is sufficiently large to provide a sealing surface with seating surface 54 in a deflected position.

In operation, pneumatic cylinder 40 moves shaft 44 along a vertical axis, such that flexible disk 56 is raised or lowered to mate with annular seat 52. Shaft 44 is guided by bearings 50, 64 and 66. When shaft 44 is in its lowest position, the flexible disk damper is in an open position such that flue gases from duct 12 pass around deflection cone 68 through annular seat 52 into duct 30. Deflection cone 68 minimizes turbulence in the flue gas and promotes smooth flow of flue gas from duct 12 in duct 30. Deflection cone 68 also protects flexible disk 56 from direct impingement of flue gas on its lower surface.

Pneumatic cylinder 40 is capable of applying a predetermined vertical force on shaft 44 to raise flexible disk 56 into annular seat 52 to cause deflection of flexible disk 56 in the seating surface 54. Annular seat 52 has an inherent warpage which results from its large diameter and use over a wide range of temperatures, e.g. from room temperatures up to 950° F. Flexible disk 56 provides sufficient flexibility to compensate for inherent warpage of annular seat 52 and form a tight seal with seating surface 54 for any circumferential orientation of flexible disk 56. In other words, it is not necessary to provide anti-rotation guides on shaft 44 to ensure that flexible disk 56 repeats its positioning location on the seat for each closing. Rather, flexible disk 56 provides sufficient deflection to form a tight seal with seating surface 54 for all orientations. Pneumatic cylinder 40 provides a constant force on shaft 44 to ensure that flexible disk 56 forms a tight seal with seating surface 54. The force applied by pneumatic cylinder 40 is an additive force with the force of gas pressure from duct 12. The force applied by cylinder 40 can be varied in accordance with gas pressure in duct 12. However, bearing 64 limits travel of disk 56 to keep from permanently deforming the disk.

Flexible disk 56 is formed from a plurality of disks 58–62 having various diameters. Disks 58–62 are arranged by size and provide a different cross-sectional thickness at various locations along the radius of flexible disk 56 to ensure that forces required to deform flexible disk 52 in the closed position and forces produced by gas pressure just after opening which tend to "backcamber" the flexible disk produce a unit stress at all points along its radius 56 which is less than the yield point of the metal used in the flexible disk. Since unit stress increases with radial distance toward the center, cross-sectional thickness also increases with radial distance towards the center of flexible disk 56. The present invention utilizes a steel which has 10–15% higher yield points than carbon steel, such as Corten steel produced by United States Steel, so that large amounts of deflection can be provided without producing a unit stress which exceeds the yield point of the metal. For example, using conventional carbon steel, deflection of only several hundredths of an inch can be obtained without exceeding the yield point of the metal, for diameters of up to 5 feet, while Corten steel is capable of providing deflections of approximately 1 inch for diameters of 5 feet.

Figure 4:
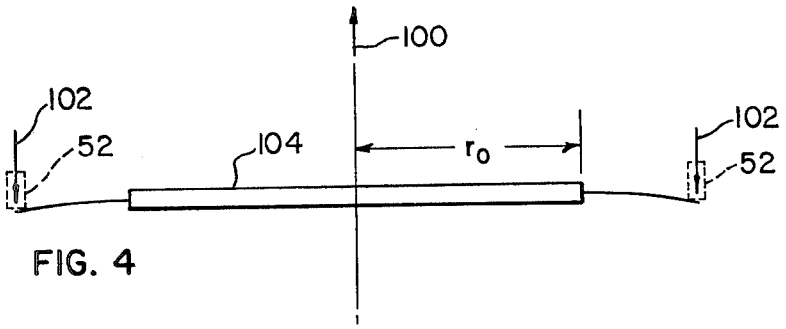
FIGS. 4–6 illustrate the forces present on the flexible disk damper in the open and closed positions.
Figure 5:
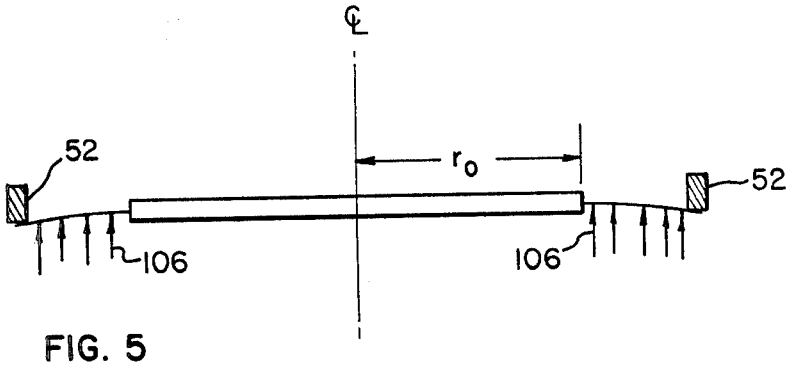
Figure 6:
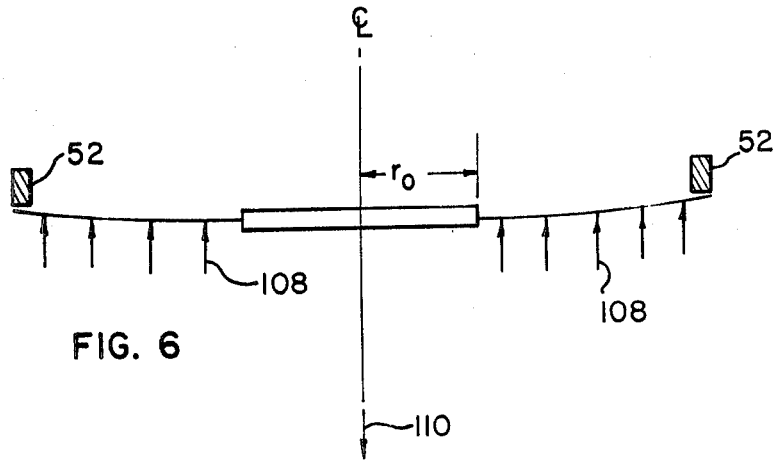

FIGS. 4–6 disclose the various forces acting upon flexible disk 56. FIGS. 4 and 5 show the forces on flexible disk 56 in the closed position, i.e., when the disk is seated against annular seat 52. FIG. 4 illustrates the force 100 of pneumatic cylinder 40 and the resultant force 102 produced by annular seat 52 on flexible disk 56. Referring to "Formulas for Stress and Strain" Fifth Edition, 1975, by Raymond J. Roark and Warren C. Young, McGraw-Hill Book Co. New York, p. 335, equation 1.b. provides a method of determining stress produced on flexible disk 56 for the example given in FIG. 4. To ensure that unit stress at all points along the radius of flexible disk 56 does not exceed the yield point of the metal used in the disk, $r_o$ must be studied for the outer radius of each leaf and the shaft assuming that each successive inner portion, represented by element 104, is an inflexible support.

FIG. 5 is a representation of the forces 106 contributed by gas pressure on flexible disk 56 in the closed position. Equation 2.b., p. 337 of the above referenced text, provides a method of determining total stress due to gas pressure. To ensure that unit stress at all points along the radius of flexible disk 56 does not exceed the yield point of the metal used in the disk, $r_o$ must be studied for the outer radius of each leaf in the same manner as eq. 1.b., and unit stress added to that calculated in eq. 1.b. to ensure that the total unit stress does not exceed the yield point of the metal.

FIG. 6 illustrates the forces due to gas pressure on flexible disk 56 just as the disk is opened, i.e., separated from damper seat 52, in response to a force 110 from pneumatic cylinder 40. Using eq. 21, p. 342 of the above referenced text, unit stress can be determined by studying $r_o$ for the outer radius of each leaf and shaft radius to ensure that the yield point of the metal is not exceeded. Allowable deflections can also be determined in the same manner as stresses for the examples of FIGS. 4–6.

Figure 3:
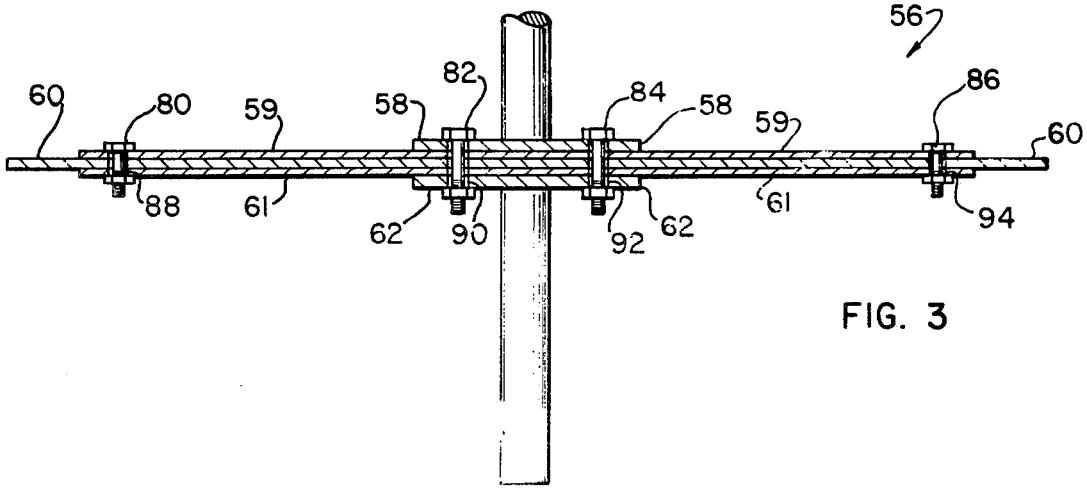
FIG. 3 is a cross-sectional diagram of the flexible disks illustrated in FIG. 2.

The plurality of flexible disks 58–62 are coupled together to allow the disks to independently flex during deformation and therefore provide for maximum deflection. As illustrated in FIG. 3, a plurality of bolts 80, 82, 84, 86 are disposed through holes 88, 90, 92, 94, respectively, to couple the plurality of flexible disks 58–62. Holes 88, 90, 92, 94 are made larger than bolts 80, 82, 84, 86 to allow flexible disks 58–62 to move independently and allow maximum deformation of flexible disk 56.

Annular seat 52 can be formed from a round cut plate or a welded flat bar to form an annulus as shown in FIG. 2. A flat bar formed in an annulus has less warpage for large diameters than a round cut plate and is somewhat less expensive to fabricate and implement. Since the flexible disk means 56 is capable of large deflection, less expensive flat bars can be used while maintaining tight damper seals.

Control arm 74 is mounted on shaft 44 and functions to control indicator switches 46, 48 to provide a reliable indication of the opened or closed position of the damper.

Consequently, the present invention provides a flexible disk damper which is capable of forming a tight seal for large diameter dampers, i.e., greater than 4 feet. The flexible disk provides sufficient flexibility to compensate for inherent warpage in the annular seat for all circumferential orientations of the flexible disk. Less expensive flat bars can be used as annular seats to decrease costs and simultaneously provide a tight seal which was not obtainable in prior art large diameter disk type dampers. Additionally, a tight seal is formed regardless of the circumferential orientation of the flexible disk and, consequently, anti-rotation guides are not required. The flexible disk has a cross-sectional thickness which varies with radial distance so that the flexible metal has a yield strength which is sufficient to prevent permanent deformation. In other words, the cross-sectional thickness of the flexible disks varies with radial distance such that the force required to deform the flexible disk produces a unit stress which is less than the yield point. The design therefore ensures a tight damper seal without permanent deformation of the flexible disk.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A flexible disk damper which is capable of providing a substantially air-tight seal for an opening of at least 4 feet in diameter over a range of temperatures from room temperature to 950° F. comprising:

annular seat means for forming an annular damper seat having an annular ring configuration, said annular seat means having an inherent predetermined warpage resulting from said diameter of at least 4 feet and operation of said flexible disk damper over said range of temperatures which can vary from room temperature to 950° F.;

multiple disk means having sufficient flexibility to deform by a predetermined amount capable of compensating for said inherent predetermined warpage and providing a substantially air-tight seal between said annular seat means and said multiple disk means for any circumferential orientation of said multiple disk means with said annular seat means, said multiple disk means comprising:

central disk means having a diameter sufficient to engage said annular seat means along peripheral portions of said central disk means to form said substantially air-tight seal and having sufficient flexibility to deform by said predetermined amount;

support disk means disposed on opposing sides of said central disk means for supportingly joining said central disk means on said opposing sides of said central disk means by providing a supporting structure having a diameter and thickness sufficient to allow deflection of said central disk means in opposing directions by said predetermined amount while simultaneously preventing production of unit stresses on said central disk means which exceed the yield point of said central disk means as a result of the leveraging of forces which are produced on said peripheral portions of said central disk means to both open and close said flexible disk damper;

coupling means for joining said central disk means and said support disk means to simultaneously provide support and movement between said central disk means and said support disk means to allow said central disk means and said support disk means to independently flex;

additional support disk means disposed on opposing sides of said support disk means for supportingly joining said support disk means on said opposing sides of said support disk means by providing a supporting structure having a diameter and thickness sufficient to allow deflection of said support disk means in opposing directions to allow said central disk means to deform sufficiently to form an air-tight seal while simultaneously preventing production of unit stresses on said support disk means which exceed the yield point of said support disk means as a result of the leveraging of forces which are produced on said support disk means from said central disk means to both open and close said flexible disk damper;

additional coupling means for joining said support disk means and said additional support disk means to simultaneously provide support and movement between said support disk means and said additional support disk means to allow said support disk means and said additional support disk means to independently flex.

2. The flexible disk damper of claim 1 wherein said support disk means comprises multiple disks having multiple diameters.

3. The flexible disk damper of claim 1 wherein said additional support disk means comprises multiple disks having multiple diameters.

4. The flexible disk damper of claim 1 wherein said coupling means comprises bolts disposed in holes in said central disk means and said support disk means which are sufficiently large to allow said central disk means and said support disk means to independently flex.

5. The flexible disk damper of claim 4 wherein said additional coupling means comprises bolts disposed in holes in said support disk means and said additional support disk means which are sufficiently large to allow said central disk means and said support disk means to independently flex.

6. The flexible disk damper of claim 1 wherein said predetermined amount is approximately one inch for flexible disk dampers having openings of approximately 5 feet in diameter.

7. The flexible disk damper of claim 1 wherein said yield point of said metal is at least 10% greater than the yield point of carbon steel.

* * * * *